US006111969A

United States Patent [19]

Babb

[11] Patent Number: 6,111,969

[45] Date of Patent: Aug. 29, 2000

[54] HIGH FIDELITY, BROAD BAND ACOUSTIC LOUDSPEAKER

[76] Inventor: Burton A. Babb, 6618 Briarhaven Dr., Dallas, Tex. 75240

[21] Appl. No.: 08/853,400

[22] Filed: May 9, 1997

[51] Int. Cl.[7] ..... H04R 7/14

[52] U.S. Cl. ..... 381/396; 381/397; 381/398; 381/400; 381/403; 381/404; 381/405; 381/407

[58] Field of Search ..... 381/396, 397, 381/398, 400, 403, 404, 405, 407

[56] References Cited

U.S. PATENT DOCUMENTS

| | | | |
|---|---|---|---|
| 2,814,353 | 11/1957 | Olson et al. . | |
| 2,860,721 | 11/1958 | Hassan . | |
| 3,201,529 | 8/1965 | Surh . | |
| 3,684,052 | 8/1972 | Sotome | 181/32 R |
| 3,980,841 | 9/1976 | Okamura et al. | 179/181 |
| 3,983,337 | 9/1976 | Babb | 179/115.5 R |
| 4,115,667 | 9/1978 | Babb | 179/115.5 VC |
| 4,188,711 | 2/1980 | Babb | 29/594 |
| 4,235,302 | 11/1980 | Tsukamoto | 181/172 |
| 4,239,943 | 12/1980 | Czerwinski | 179/115.5 VC |
| 4,297,537 | 10/1981 | Babb | 179/180 |
| 4,933,975 | 6/1990 | Button | 381/192 |
| 5,455,396 | 10/1995 | Williard et al. | 181/172 |

*Primary Examiner*—Curtis A. Kuntz
*Assistant Examiner*—Phylesha L. Dabney
*Attorney, Agent, or Firm*—Marc A. Hubbard; Munsch Hardt Kopf & Harr, P.C.

[57] ABSTRACT

A broad band loudspeaker (101) includes a diaphragm (103) driven by coil assembly (125) centered on a pole (131) of a magnet assembly (133) by a low-friction guide (127) depending from a lower end the coil assembly, and a low-friction guide mounted on an upper end of the pole (131). A suspension (107) for the diaphragm (103) includes two or more parallel, resilient suspension members (115*a*, 115*b*), extending between the diaphragm (103) and frame (105) and mounted through a pair of resilient mounting pads (119*a*, 119*b*, 125*a*, 125*b*). The lower guide (127) includes a flexible portion (151*a*) which acts like a flapper valve of a pump to create a current of cooling air past down the inside of the coil assembly (125), up the outside of the coil assembly and then out of flux gap (130). Cooling fins (167) mounted on an upper side of the magnet assembly (133) promote transfer of heat to the inside of enclosure (121) and are arranged for the current of air from the flux gap to flow past the fins and into an enclosure (121).

30 Claims, 4 Drawing Sheets

HIGH FIDELITY, BROAD BAND ACOUSTIC LOUDSPEAKER

FIELD OF THE INVENTION

The invention relates to acoustic loudspeakers.

BACKGROUND OF THE INVENTION

To provide the greatest listening pleasure, an acoustic loudspeaker system must meet several basic requirements. First, it must be capable of reproducing very low frequencies, such as bass notes below 50 Hz, which are felt, not heard. Second, it must be capable of reproducing overtones of high musical notes. Third, it should have a relatively flat frequency and phase response over the full range of human audible frequencies, from about 40 Hz to about 20,000 Hz in order to reproduce sound with fidelity to the source. Fourth, also to be faithful to the source, the system should recreate whatever spatial illusions are contained in the source material. For example, most music sources are encoded for stereo reproduction using two channels. Two, spatially separated and phase-synchronous infinitesimal point sources of acoustic energy theoretically provide the best stereo imaging, for they are able to create the illusion of sound originating from any point along a line extending through both point sources. Therefore, a loudspeaker system should imitate as closely as possible two infinitesimally small point sources of acoustic energy. Fifth, to accommodate wide dynamic ranges, a loudspeaker system must be able to handle signals with power sufficient to reproduce low frequencies at loud volumes without distortion to the sound or damage to the speaker.

Conventional belief is that a single acoustic driver cannot deliver a frequency range and power handling capability required for high fidelity sound reproduction and demanded by audiophiles. Therefore, to meet these demands, most loudspeaker systems rely on two or more acoustic transducers or drivers per channel. Each driver of a channel is responsible for reproducing sounds in only in preselected portions of the audible range. As more fully explained below, characteristics which optimize an acoustic driver or transducer for high frequency sound are often opposite of those which optimize a driver for low frequency response. By utilizing multiple drivers per channel, each driver may be optimized to operate within a selected portion of the acoustic range. An electrical circuit, known as a cross-over network, splits portions of the energy of the input signal between the drivers, depending on the frequency of the energy in the signal.

Despite their widespread acceptance, multi-driver speakers have several drawbacks. First, cross-over networks distort the electrical sound signal, thus introducing distortion into the sound reproduced by the loudspeaker system. For example, cross-over networks naturally cause phase distortion in incoming signals: higher frequencies will be phase shifted with respect to the lower frequencies. Phase shifting results in a loss of clarity, causing the music to sound "muddy." Cross-over networks therefore sometimes employ complex circuits to correct phase distortion. These complex cross-over networks then often introduce other types of distortion and often possess non-linear responses. Second, multi-driver speaker systems tend to be larger and have more components, thus making them more expensive, bulkier and less mobile. Third, a multi-driver speaker does not satisfactorily represent a point source of acoustic radiation for a single channel, as a channel is obviously radiating from multiple points. Thus, they cannot achieve the best stereo imaging.

Nevertheless, they are still preferred over single driver loudspeaker systems. The problems of using a single driver to reproduce at equal levels high notes with clarity and low notes with physical impact are difficult to overcome. A conventional acoustic transducer has a relatively stiff or rigid diaphragm which reciprocates along a linear axis. For reproducing low frequencies, the diaphragm has preferably a concave, cone shape. For high frequencies, it may be flat or convex. To vibrate the diaphragm, an electrical signal representing the sound wave to be reproduced flows through a coil mechanically connect to the diaphragm. The coil is situated within a fixed magnetic field, causing the coil to reciprocate with changes in the current. The coil is formed from one or more lengths of wire wrapped around a support structure. Typically, the edges of the diaphragm are attached to a basket shaped frame using a compliant, slightly resilient, material. The coil is centered within a gap referred to as a "flux gap," formed between cylindrically shaped pole and a donut-shaped magnet assembly. The prevalent structure for centering the coil within the flux gap is a corrugated cloth impregnated with resin, referred to as a "rear suspension," that extends from coil to the frame.

To provide the most accurate sound reproduction, the movement of the coil in response to the electrical signal and the coupling of the movement of the diaphragm to the air in response to the movement of the coil must be linear. Unfortunately, the responses of these elements to the sound signal are rarely totally linear, especially over the entire audible range. The diaphragm couples the mechanical energy of the moving coil to the air, thereby causing the air to vibrate and setting up acoustic waves. At lower frequencies, the diaphragm can be thought of as behaving like a simple mechanical piston pushing volumes of air. At low frequencies, a lot of power is required to push large volumes of air, particularly at loud volumes. Therefore, to sound low notes with great volume a speaker must be capable of handling a lot of power, particularly the mechanical stresses from the strong electromagnetic forces and resulting heat.

For good low frequency response, a driver is needed which is mechanically strong and powerful in order to move larger amounts of air. Thus, a stiffer diaphragm with a large surface area is preferred. However, a large, stiff diaphragm means more structure, and thus more mass. More mass means less efficiency, and thus more power to reproduce the same loudness. More power means that a more massive coil is required to handle the mechanical and thermal stresses resulting from the power. However, more mass in the moving parts inhibits the driver's ability to reciprocate at higher frequencies. Also, it is more difficult to control coupling of the movement of the coil to the air through a large diaphragm and its natural resonances. A smaller diaphragm could be used to sound bass notes, but a longer throw or stroke of the coil would be required to move the same amount of air. However, a longer stroke necessitates either a magnetic field of greater magnitude or a longer coil in order to provide a sufficiently high electromotive force (EMF). Furthermore, a greater coil length means greater induction. Thus, the length of the coil is limited. A long stroke also requires the coil to move at a higher velocity. Higher velocities will create a higher back EMF, which resists travel of the coil and ultimately limits the ability of the driver to reproduce low frequencies.

At higher frequencies, the diaphragm behaves more like a radiating transmission line. The rapid vibrations of the coil cause not only linear movement of the diaphragm, but also mechanical vibrations in the diaphragm which radiate from the points where the coil is attached, outwardly to the edge of the diaphragm. Depending on the material, size of the diaphragm and how it is attached to the suspension, these vibrations may resonate at certain audible frequencies, thus adversely affecting the linearity of the coupling of the mechanical movement of the coil to the air. Although there may be mechanical deformation of the diaphragm at all frequencies, at high frequencies the effect of resonant vibrations will have a substantial impact on the sound, with certain frequencies being noticeably enhanced and others degraded. Reproducing a high frequency sound also requires the coil to be quickly accelerated. Thus, a near zero mass coil and diaphragm is theoretically ideal. Furthermore, a smaller diameter diaphragm is preferred. A larger diameter diaphragm tends to be more directional, exacerbating the directional nature of high frequencies.

Finally, whether a small or large diaphragm is used, the suspension system must be very compliant to accommodate the range of movement of the coil, yet have enough spring force to keep the diaphragm centered in a neutral position. Compliance is required when sounding low notes in order to avoid interference and damage. A large spring force works against movement of the diaphragm and will tend to bend it. However, a compliant suspension tends to resonate and will not dampen undesirable resonances in the mechanical structure of the diaphragm at higher frequencies, resulting in the suspension vibrating out of phase with the diaphragm and a loss of energy.

Attempts have been made to accommodate the demands of high and low frequencies in a single, broad band acoustic driver, particularly in the area of reducing the mass of the moving parts of the driver. For example, as shown in U.S. Pat. Nos. 4,115,667 and 4,188,711 of Babb, the conventional rear suspension for the coil is replaced with a low friction bearing made of TEFLON®. The bearing is formed at the bottom of the coil, opposite of where it connects to the diaphragm, and encircles and rides on the post. The coil remains centered within the gap without the extra mass of the rear suspension and its spring forces interfering with movement of the coil. The coil therefore can move more freely and accelerate faster, which aids in moving the coil long distances when using a longer throw coil to sound bass notes. Lightweight, stiff metal alloys have been used to form diaphragms. Coil forms (structures for supporting windings of coils) have been made from high strength, thermally resistant materials such as KAPTON®. To provide a low mass, compliant suspension for the diaphragm, a stamped synthetic foam having a very low density with good dampening and resonance characteristics is used.

Nevertheless, although not recognized in the art, there still exist problems. First, a coil undergoes great mechanical stress from the EMF generated by the magnet and the current running through the coil, as well as great thermal stress from the substantial heat generated when large currents flow through the coil during reproduction of loud notes. Despite the use of lightweight, stiff materials, a low mass coil capable of sounding both high and low frequencies will naturally tend to be weaker and thus more easily deformed by the mechanical and thermal stresses suffered during reproduction of high power sounds. A deformed coil cannot sound notes as accurately and will tend to rub against the walls defining the flux gap, causing noticeable distortion of low notes and extraneous noises at midrange frequencies. Second, a low mass coil also cannot store heat for later dissipation. Thus, during extended periods of loud notes, a low mass coil will tend to get very hot and become damaged. Furthermore, TEFLON® is not structurally strong and tends to shrink in heat, thus resulting in increased drag of the coil's bearing on the post and deformation under high thermal and mechanical loads. Third, a low density suspension is relatively transparent to sound. Thus, acoustic energy directed rearwardly into the enclosure in which the driver is mounted will leak through the suspension, resulting in sound which is slightly murky due to the delay in the reflected sounds mixing with the sound emanating directly from the driver. Fourth, the suspension, due to large excursions, becomes fatigued where it joins the diaphragm and the frame. Fifth, the thin metal used to form a diaphragm still bends, creating a non-linear response, and eventually becomes fatigued.

SUMMARY OF THE INVENTION

Briefly, a loudspeaker driver according to the present invention provides enhanced broad band performance over the prior art. A preferred embodiment of a broad band loudspeaker driver as described below has several inventive aspects, each of which done or in combination with others has as an objective solving one or more of the forgoing problems. Following is a brief summary of some of these aspects, which summary is not intended to limit the scope of the appended claims.

A low friction guide may be formed around the top of a center pole of a magnet assembly of a loudspeaker transducer or driver. The guide on the post tends to prevent temporary and permanent distortion of a coil, and to keep the coil centered within the flux gap during periods of substantial thermal stress or large mechanical load. The guide is not normally intended to extend so far as to touch the inside of the coil so that air is not trapped between the first and second bearings. Trapped air may create a spring effect. As a consequence, the coil can be made longer, with a longer stroke, thus enhancing lower frequency production. Also, the adverse effects of rubbing of the upper coil on the post will be alleviated, thus reducing noise and distortion.

A suspension for a diaphragm of a loudspeaker transducer may include a plurality of low mass suspension members. Each suspension member is spatially separate from, but parallel to, an adjacent member. The additional suspension member enhances sound blockage at the gap between the diaphragm and a frame in which it is mounted, without adding significant additional spring force which would interfere with movement of the diaphragm. The parallel orientation of members ensures a constant volume of air between them so that air trapped between the layers does not act like a spring. With greater blocking of the sound in the enclosure, clearer sound reproduction results.

Each suspension member may be coupled to a speaker's frame and to a diaphragm through a pair of resilient pads. The pads are stretchable and compressible in all directions and thus increase the range of movement for the suspension. Thus, the gap between the speaker diaphragm and the frame can be made narrower without limiting the range of movement of the diaphragm, resulting in less sound leakage from around the diaphragm.

To enhance transfer of heat away from a coil to reduce thermal stress on the coil, a lower bearing on the coil may be formed to act like a flapper valve in a pump to induce a one-way flow of air between the coil and pole on which the lower bearing rides, through the bearing and then up the other side of the coil. The flux gap formed between the pole piece and a magnet assembly, in which the coil is mounted, may then be extended to cause this current of air to flow closely across the full length of the coil. Cooling fins may be mounted atop a magnet assembly to improve heat dissipation from the magnet assembly and oriented such that the current of air from the coil and the currents caused by the oscillation of the diaphragm flow past the fins. Transferring more heat from the coil and fins to the air inside the enclosure in which the speaker is mounted tends to increase the temperature of the air in the enclosure. Increased temperature means that the air in the enclosure will be less dense and thus exert less pressure against the speaker's diaphragm. Since there is less pressure, the speaker need not work as hard to move the diaphragm back, against the air in the enclosure. Less work means greater efficiency (energy in sound output versus energy in input signal), thereby compensating for any efficiency lost in the coil and magnet due to increased temperatures.

The foregoing and other inventive aspects and advantages are exemplified by several embodiments of the invention, described below in connection with the appended drawings.

DETAILED DESCRIPTION OF A PREFERRED EMBODIMENT

In the following description, like numbers refer to like parts.

Figure 1:
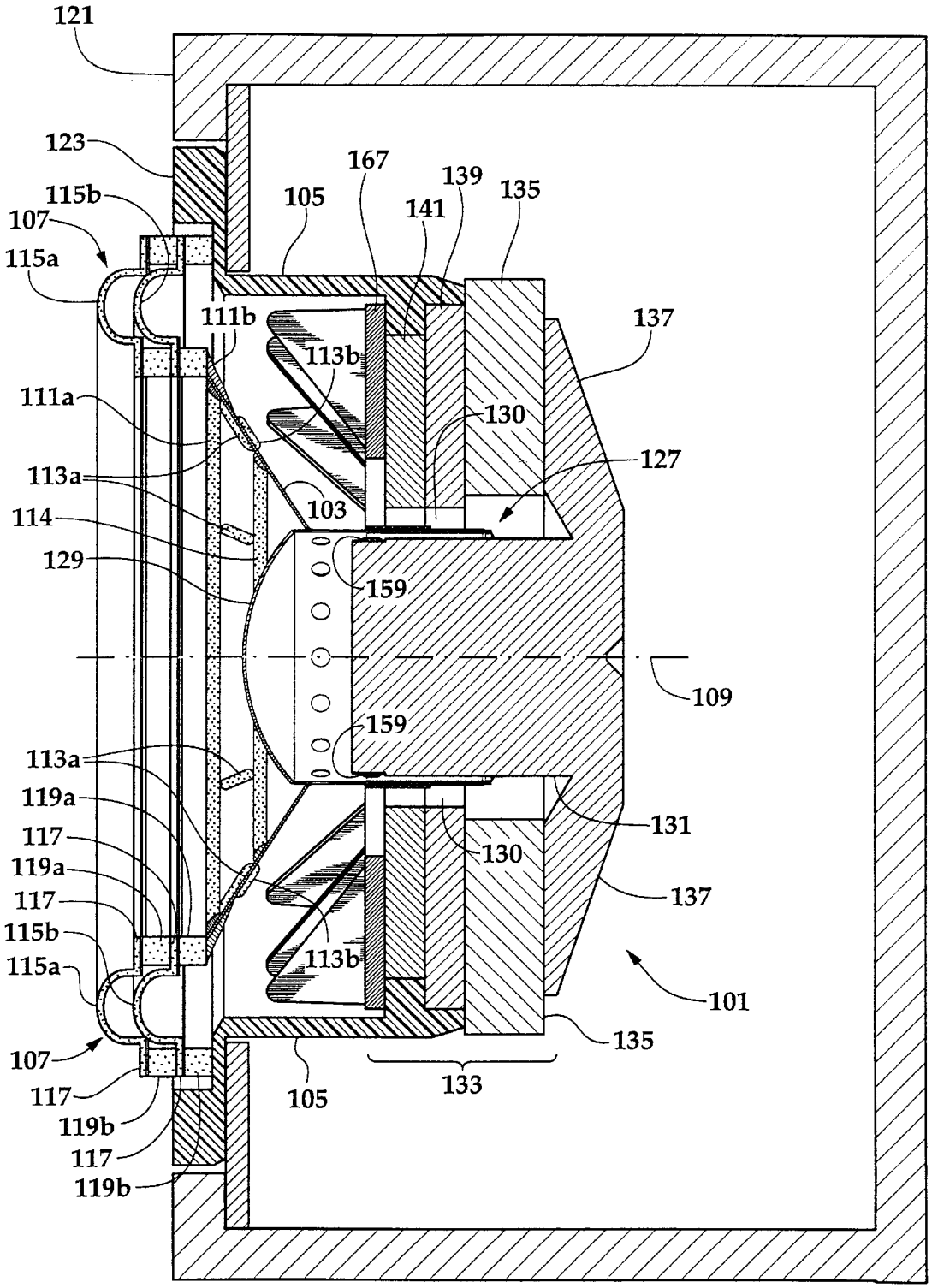
FIG. 1 is a cross-section of a loudspeaker mounted within an enclosure.

Referring now to FIG. 1, broad band acoustic driver 101 includes a diaphragm 103 suspended from frame 105 by suspension 107. The suspension allows the diaphragm to be moved in a piston-like, reciprocating fashion along axis 109 while remaining centered about the axis. The diaphragm is preferably cone shaped and made of an aluminum alloy that is both light weight and stiff. Bonded to opposites sides of the cone, around its outer edge or perimeter, are stiffening rings 111*a* (on a front side of the cone) and 111*b* (on a back side of the cone). These two rings are made of a lightweight, relatively thick, relatively stiff material. The two rings, disposed on opposite sides of the diaphragm, cooperate to form a relatively thick, sandwich-like structure which resists flexing or bending along the outer edge of the cone where it is attached to the suspension 107. The rings will also tend to dampen any vibrations which may otherwise tend to develop from interplay of the diaphragm and the suspension 107. The rings may be formed, for example, by laying down a thin line of a epoxy in which is suspended glass or plastic micro spheres containing gases which cause it to foam during curing to create a relatively thick lightweight, stiff structural member that has good mechanical strength (in compression and tension) and bonds with the diaphragm. One such microsphere material for mixing with epoxy to cause it to foam during curing is sold under the trademark MICROLITE®.

Diaphragm 103 is also stiffened against flexing by ribs 113*a* (on the front side of the cone) and 113*b* (on the back side of the cone). The ribs are aligned along radii of the diaphragm. The ribs form a sandwich structure which resists bending of the diaphragm caused by, for example, suspension 107 pulling on the diaphragm. The ribs 113*a* preferably extend between the outer stiffening ring 111*a* and an inner stiffening ring 114. The network of ribs and stiffening rings allow the diaphragm to be "tuned" by altering its flexibility at various distances from its center to provide a more even response. As shown, the bracing changes the flexibility between the inner and outer portions of the diaphragm to reduce the frequency response of the diaphragm around the middle of the audio range. A foaming epoxy may be used to form the ribs in the same fashion as the stiffening rings 111*a* and 111*b*.

Figure 2:
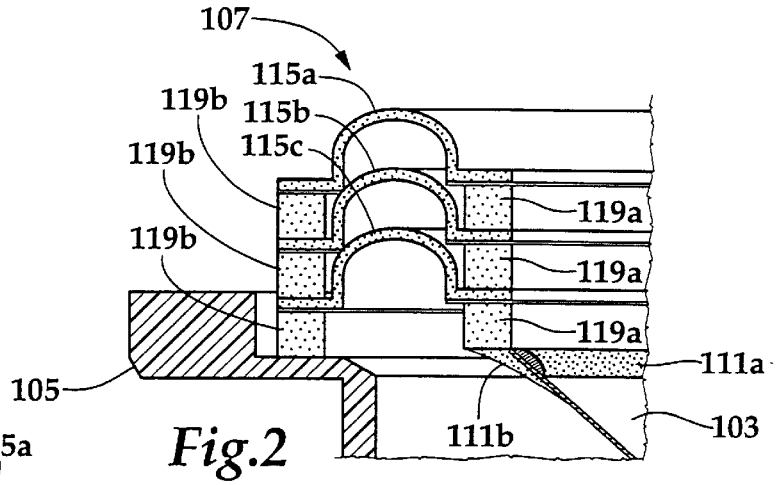
FIG. 2 is a cross-section of an alternate embodiment for a suspension for the speaker of FIG. 1.

The suspension 107, in one embodiment, is comprised of two ring-shaped suspension members 115, the upper member labeled as 115*a* and the lower member labeled as 115*b*, which extend in parallel from the frame 105 to the diaphragm 103. The suspension members are resilient, but otherwise relatively compliant. The objective of having two, or three suspension members 115*a*, 115*b* and 115*c* as shown in the embodiment of FIG. 2, will be explained shortly. Each suspension member has a "U" shaped cross section or "roll" and a mounting flange on each side thereof. The roll acts something like a resilient spring. It will exert a mild force in directions perpendicular and parallel to axis 109, depending on which directions the flanges are pulled with respect to each other. The mild spring forces act to center or position the diaphragm in a neutral position when quiescent. They also help maintain the diaphragm centered about axis 109 during excursions of the cone along axis 109. Otherwise, the suspension members are very compliant so as to minimize counteracting forces on the movement of the diaphragm. Also, they are very low mass in order to minimize the mass of the moving portions of the loudspeaker. In a preferred embodiment, such members are made of a sheet of very low density synthetic foam which is stamped to form the roll and cut into the ring shape. The flanges of the suspension member are mounted on a pair of ring shaped, resilient mounting pads 119. The inner mounting pad is referenced as 119*a* and the outer mounting pad is referenced as 119*b*. The inner mounting pad 119*a* for the suspension member 115*b* is mounted on a footing formed by a flat edge presented by the lower stiffening ring 111*b*. The mounting pads 119 are formed, for example, from a resilient, but compliant synthetic foam cushion of low density. The thickness of the pads may be varied to compensate for differences in the levels of edge of the suspension member (when the diaphragm is in a neutral position) and the frame.

Figure 3A:
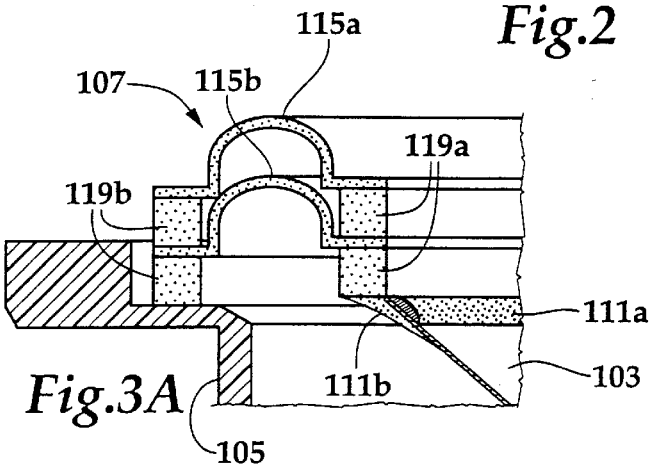
FIGS. 3A, 3B and 3C illustrate the behavior of a suspension of a diaphragm of a loudspeaker at successive positions of the diaphragm.
Figure 3B:
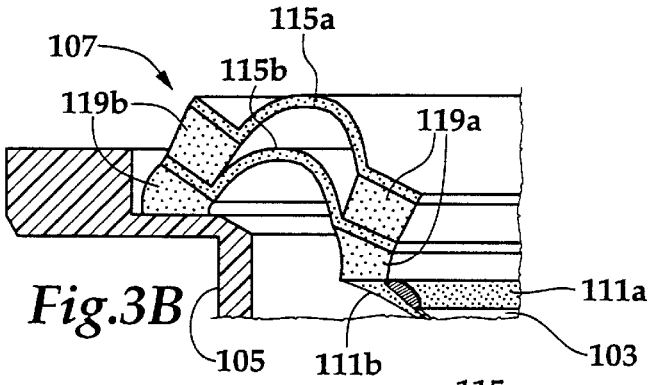
Figure 3C:
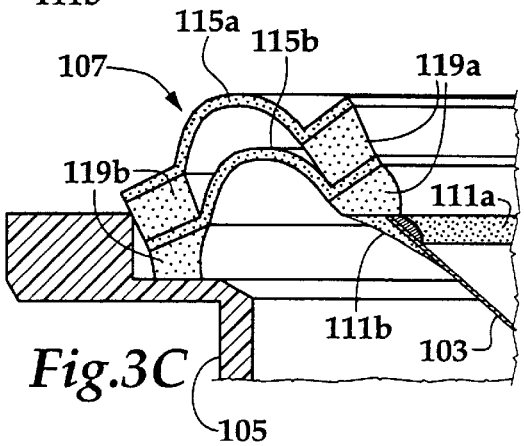

Referring briefly to FIGS. 3A, 3B and 3C, the ring shaped, resilient mounting pads 119 act, in part, as compliant, but resilient, springs—i.e. springs with very low spring rates. Like suspension members 115*a* and 115*b*, each pair of mounting pads 119*a* and 119*b* provide minimal spring forces both parallel and perpendicular to axis 109 which assist with urging the diaphragm to a neutral position when quiescent and centering the diaphragm along axis 109 during its excursions. However, the mounting pads also allow the diaphragm 103 to move farther in each direction along axis 109 than would otherwise be possible using only suspension members 115*a* and 115*b*. The "U" shaped cross section allows each suspension member 115*a* and 115*b* to be deformed like a spring, but the material cannot otherwise be stretched beyond a certain point without tearing due to the delicacy of the material preferably used to make the suspension. To illustrate this point, consider FIGS. 3A–3C in succession. In FIG. 3A, the diaphragm 103 is in the neutral position. In FIG. 3B, the diaphragm is moved downwardly.

Suspension members 115*a* and 115*b* have become slightly stretched, causing the lower one of the mounting pads 119*b* to bow inwardly (toward the diaphragm) and compress on its inward edge, and the lower one of the mounting pads 119*a* to be stretched upwardly and outwardly (away from the diaphragm). In FIG. 3C, the diaphragm 103 is moved upwardly, causing similar, but opposite deformations in the mounting pads 119*a* and 119*b*. As can be seen from the drawings, the volume of air between the suspension members 115*a* and 115*b* remains substantially constant, thereby avoiding introduction of undesirable additional springiness in the suspension due to trapped air, which additional springiness would impede movement.

Referring now to FIGS. 1, 2 and 3A–3C, movement of diaphragm creates sound pressure waves not only in front of the diaphragm, but also behind the diaphragm which propagate into enclosure 121. Frame 105 includes a flange 123 for mounting to the speaker to enclosure 121. The enclosure substantially blocks the rearward directed waves from propagating into the environment. However, a gap between diaphragm 103 and the inside edge of the frame 105, bridged by suspension 107, will tend to allow a portion of the pressure waves to leak out of the enclosure. The suspension is, as previously explained, preferably of low density and thickness. Thus, it will tend not to block effectively the transmission of sound energy in the air. The effect of the leaking sound is to muddy the sound coming off the front of the diaphragm, making it less distinct due, in part, to a slight phase delay and the spatial separation of the gap from the diaphragm. Placing two or more suspension members parallel to each other, with rolls in each oriented the same direction, enhances blocking without introducing extra spring forces or otherwise interfering with the free movement of the diaphragm. The enhanced blocking comes about, in part, from the additional impedance mismatches between, for example, the air trapped between the suspension members 115*a* and 115*b*, and suspension member 115*a*. Air trapped between adjacent suspension members, however, will not act like a spring, as each suspension member deforms in a similar manner and therefore maintains a substantially constant volume of air between any two members. The relative thickness of foam pads 119*a* and 119*b* block sound.

Figure 4A:
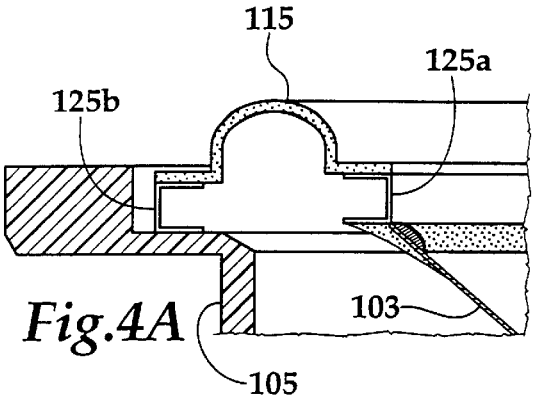
FIGS. 4A, 4B and 4C illustrate the behavior of the suspension of FIGS. 3A–3C in an alternate embodiment.
Figure 4B:
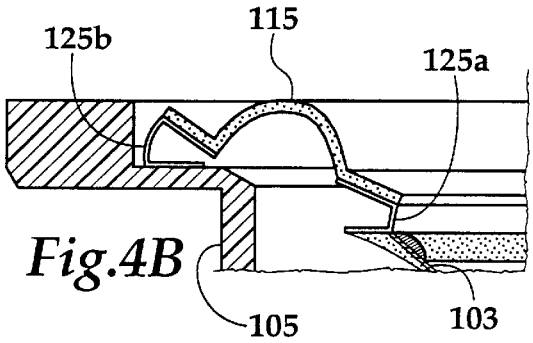
Figure 4C:
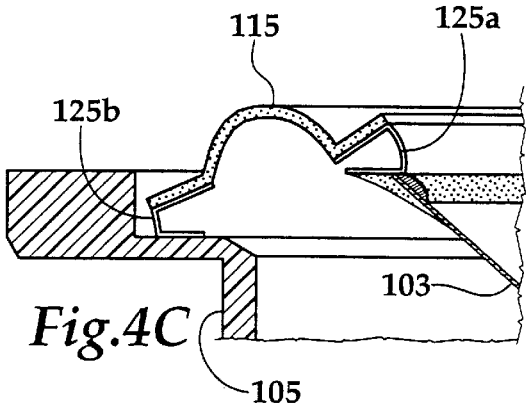

Referring now to FIGS. 4A–4C, rather than as foam cushions, mounting pads 119*a* and 119*b* (FIGS. 1–3) may take the form of resilient plastic mounting pads 125*a* and 125*b*, respectively, have "C" shaped cross-sections. As shown in the drawing, the "C" shaped, plastic mounting pads are compressed and stretched in a manner similar to that of the foam cushions show in FIGS. 3A–3C during excursions of the diaphragm 103 along axis 109. The "C" shaped plastic mounting pads are made from a light weight plastic and are comprised of two parallel mounting flanges and one interconnecting member. The density of the plastic provides good sound blockage and tend to be more durable than foam cushions. One of two parallel mounting flanges of "C" shaped pad is a mounting for one of the flanges of the suspension member 115. The other of the two parallel flanges for attaching the mounting pad to the frame 105. Alternately, rather than a "C" shape, the interconnecting member may be arranged so that the mounting pad assumes a "Z" shape in cross-section.

Referring now to FIGS. 1, 5, 6 and 7, diaphragm 103 is driven by a cylindrically shaped, coil assembly 125. The diaphragm is attached to an upper end of the coil assembly. Dust cap 129 covers the top of the coil assembly. The coil assembly is disposed within an annular, cylindrically shaped flux gap 130 defined between pole 131 and magnet assembly 133. The magnet assembly creates a permanent magnetic field within a portion of the annular flux gap for reacting with magnetic fields induced by fluctuating currents in the coil and thereby moving or oscillating the coil. The structure of the magnet assembly will vary between loudspeakers. The magnet assembly in the depicted preferred embodiment includes a permanent magnet 135 between a bottom plate 137 (which is integrally formed with pole 131 but not need be) and first top plate 139. A second top plate 141 is included to extend the length of the annular gap to accommodate a longer coil 143.

Figure 7:
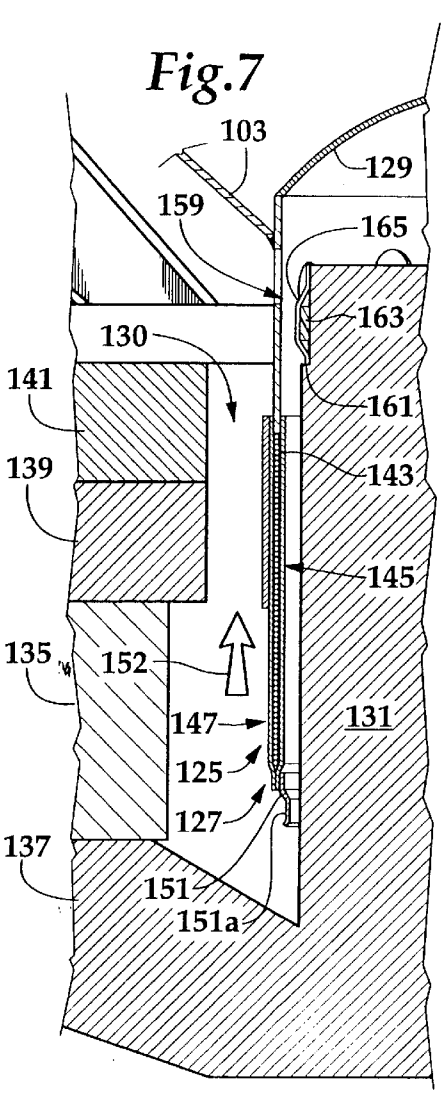
FIGS. 5, 6 and 7 are portions of cross-sections of the loudspeaker of FIG. 1 demonstrating successive positions of a coil during operation of the loudspeaker.
Figure 6:
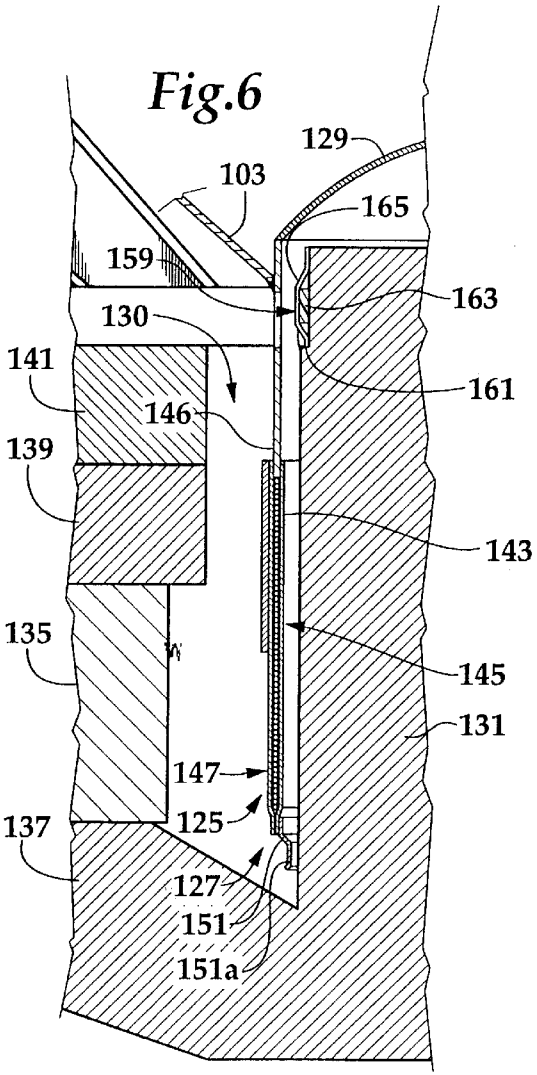
Figure 5:
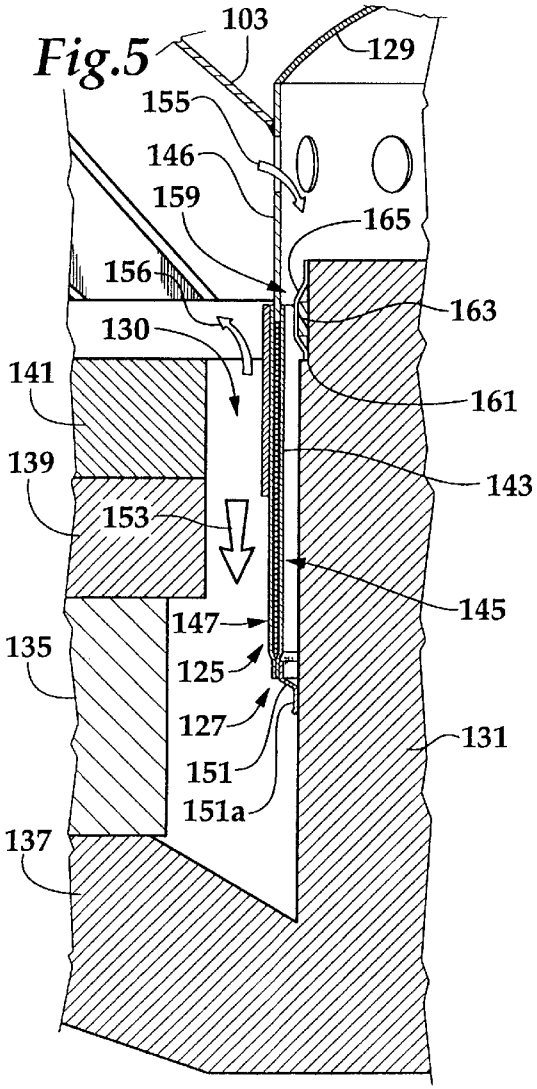

Referring now to FIGS. 5, 6 and 7 only, coil assembly 125 is formed by wrapping an appropriately shaped form (not shown) first with a base layer 145 of dielectric material of high mechanical and thermal strength. One example of such material is a tape sold under the trademark KAPTON®. Such material does not contract or stretch under the temperatures sometimes created by periods of high power consumption by the coil assembly. One or more lengths of insulated wire are wound over the base layer 145 to form the coil 143. The terminating ends of the wire are not shown. However, they are coupled to terminals (not shown) for connection to an audio signal source. A tube 146 made of a light weight metal alloy lies in the same plane as the coil 143 and provides a stiff, structural member for transferring mechanical forces to the diaphragm 103 from the windings of coil 143. The windings of the coil and portion of tube 146 are then sandwiched between the base layer 145 and an outer layer 147 of high mechanical strength dielectric material, such as a high temperature ceramic overlaying a top portion of the outer layer 147 made of a high strength, light weight dielectric material such as KAPTON®. This stiffening layer is approximately one-half the length the coil 143. The sandwich of the base layer 145 and outer layer 147 maintains the shape of the coil in a single layer and prevents windings from riding over the top of each other. The stiffening layer 149 cooperates with the base layer 145 to form a structure which resists buckling in the upper half of coil assembly that may be caused by mechanical forces acting on the coil in the direction of axis 109.

At a bottom or lower end of the coil assembly is a lower guide 127 formed of a ring 151 of flexible, low friction material, such as made from TEFLON® tape, which can easily slide on the pole 131. The lower guide assists in centering the coil assembly 125 on the pole as it reciprocates. The low friction ring 151 is attached along its top edge to the lower end of the base layer 145 of the coil assembly. A lower portion 151*a* of the ring, along its bottom edge, steps inwardly. This inward step may be formed by heating the TEFLON® tape (the form on which the coil is made having a step formed thereon).

The lower portion 151*a* of the ring 151 is flexible and will act in a manner similar to that of a flapper valve of a pump. In FIG. 5, the coil is shown moving from its neutral position downwardly, as indicated by arrow 153. Air pressure acting against the lower portion of the ring presses lower portion 151*a* of the ring against pole 131, sealing the lower end of a gap defined between the inside surface of the coil assembly and the outer surface of the pole. Consequently, as the coil assembly moves down, it will draw air into the gap between the coil assembly and the pole, generally as indicated by arrow 155, and displace air through an open top of the flux gap 130, generally as indicated by arrow 156. As air is drawn past the coil assembly and the pole, heat in the coil assembly and the pole is transferred to the air, thereby cooling the coil assembly and pole. Similarly, air passing between the magnet assembly and the outside of the coil assembly cools those assemblies.

As shown FIG. 6, the coil has reached its bottom most position and is changing direction. It has no velocity. The lower portion 151*a* of the ring has moved away from the pole 131 to its neutral position which does not touch the pole. As shown in FIG. 7, the coil assembly 125, when moving upward in the direction indicated by arrow 152, causes the lower portion 151*a* of the ring to move slightly further away from the pole to under the influence of air inside the gap between the inside of the coil assembly 125 and the pole flowing into the gap between the outside surface of the coil assembly and the inside surfaces of the magnet assembly 133. The movement of the coil thus creates a pump-like action which induces an air current to flow down the inside of the coil assembly and up the outside of the coil assembly. This air current assists in transferring heat which builds up in the coil due to electrical resistance, and thus helps to alleviate the thermal stress in the coil assembly.

Referring now to FIGS. 1, 5, 6 and 7 again, encircling the upper end of pole 131 is an upper, low friction bearing or guide 159. This guide extends slightly beyond the outer diameter of the pole, but not so far as to contact the coil assembly 125 during normal operation. Rather, it provides a low friction surface against which the inner surface of the coil assembly may bump during reciprocation. The inner surface of the coil has relatively high friction due to use of mechanically and thermally strong material. As the coil assembly may become misaligned in the gap 130 or deformed by thermal or electromotive forces, this low friction, upper guide helps keep the coil round and aligned in the flux gap, thereby reducing non-linear response of the coil and production of extraneous noise which would otherwise be caused by friction between the coil assembly and the pole. The upper guide is formed in a circumferential notch 161 defined around an upper end of pole 131. A base layer 163 of dielectric material is placed part way up the notch. It is then overlaid with a low friction layer 165, such as a strip of TEFLON®, which extends from near a bottom edge of the notch, up over the lower edge of the base layer. The low friction layer 165 thus extends slightly beyond an outer surface of the pole 131 for engaging the inside surface of the coil assembly should it come too near the pole, while its lower edge remains recessed so that it does not ever come into contact with the coil. A material may be used to form the base layer 163 which possesses a high mechanical and thermal strength, for example, KAPTON®, to better control the shape of the guide, as TEFLON® will tend to shrink or deform at higher temperatures.

Referring back to FIG. 1, to further assist in cooling magnet assembly 133, a cooling plate 167, integrally formed with a plurality of cooling fins 169 disposed radially around the plate, is attached to the top of the magnet assembly. The currents of air indicated by arrows 155 and 156 flow outwardly past the fins 169 and into then into the interior of the enclosure 121. Air currents created by movement of the diaphragm 103 also move past the fins 169. The air currents moving past the fins transfer heat from the magnet assembly to the air within the enclosure, thereby warming the air and cooling the magnet assembly. By warming the air in the enclosure, its density decreases and thus also the pressure it exerts against the backward movement of the diaphragm 103. As the air in the enclosure begins to heat up, the driver of the loudspeaker 101 need not work as hard, thus offsetting negative effects on performance and efficiency caused by increased resistance of the coil resulting from heat building up in the coil and magnet assembly during periods of high power consumption.

The forgoing embodiments are but examples of the invention. Numerous modifications may be made to the forgoing embodiments without departing from the scope of the invention as set forth in the appended claims.

What is claimed is:

1. A broad band acoustic loudspeaker comprising:

a diaphragm;

a coil assembly having a first end mechanically coupled to the diaphragm, a second end opposite the first end, and an inner surface of a first inner diameter;

a pole having an outer diameter less than the first diameter;

a magnet assembly surrounding the pole for defining therebetween an annular flux gap, the coil being operatively disposed within the annular flux gap for reciprocation along an axis;

a first guide having a low-friction outer surface disposed around the pole, near its first end, and extending beyond the outer diameter of the pole and into the annular flux gap, the first guide having a diameter less than an inner diameter of the coil assembly, thereby defining a gap through which air may flow; and a second guide on the second end of the coil, the second guide having a smooth, low-friction inner surface defining a second inner diameter less than the first inner diameter of the coil.

2. The loudspeaker of claim 1 wherein the second diameter of the second guide is greater than the outer diameter of the pole.

3. The loudspeaker of claim 2 wherein the second guide includes a flexible portion for moving toward the pole as the coil assembly moves in a first direction along the axis and for moving away from the pole as the coil assembly moves in a second direction, opposite the first direction, along the axis.

4. The loudspeaker of claim 3 further including a plurality of fins between the magnet assembly and the diaphragm, and in thermal communication with the magnet assembly.

5. The loudspeaker of claim 1 further comprising:

a frame;

a suspension for mounting the diaphragm to the frame for reciprocation along the axis, the suspension including a first resilient, suspension member extending from the frame to the diaphragm and a second, resilient suspension member extending from the frame to the diaphragm parallel to, but spatially separated from, the first suspension member.

6. The loudspeaker of claim 5 wherein the first and second suspension members are each formed of a low density, synthetic foam material.

7. The loudspeaker of claim 5 wherein the first and second suspension members each include a roll formed therein and the rolls are oriented in the same direction.

8. The loudspeaker of claim 5 wherein first suspension member includes an outer flange for mounting to the frame through an outer, resilient pad and an inner flange for mounting to the diaphragm through an inner, resilient pad.

9. The loudspeaker of claim 5 wherein the second suspension member includes an outer flange mounted to an outer, resilient pad and an inner flange mounted to an inner, resilient pad for separating the second suspension member from the first suspension member.

10. The loudspeaker of claim 1 wherein the coil assembly includes a relatively high strength dielectric base layer on which a coil is wound, and the coil assembly further includes a layer of ceramic encircling and overlaying the coil and a second, dielectric layer encircling and overlaying at least a portion of the ceramic layer.

11. The loudspeaker of claim 1 further including a suspension for coupling an outer edge of the diaphragm to a frame, a first ring formed from a first, relatively thick layer of a stiff material bonded to a first side of the diaphragm along its outer edge and a second ring formed from a second, relatively thick layer of stiff material bonded to a second side of the diaphragm opposite the first ring.

12. The loudspeaker of claim 11 wherein the stiff material of the first and the second rings includes a foamed epoxy.

13. The loudspeaker of claim 1 further including a plurality of pairs of ribs formed of a stiff, relatively thick layer of material, each rib in each pair of ribs being disposed opposite each other on opposite sides of the diaphragm and oriented along a radius extending from a center of the diaphragm toward its outer edge.

14. The loudspeaker of claim 13 wherein the stiff material of each of the plurality of pairs of ribs includes a foamed epoxy.

15. A broad band acoustic loudspeaker comprising:

a diaphragm;

a coil assembly including a coil wound around a form, the coil assembly having a first end mechanically coupled to the diaphragm and an inner surface of a first inner diameter;

a pole having an outer diameter less than the first diameter;

a magnet assembly surrounding the pole for defining therebetween an annular flux gap, the coil being operatively disposed within the annular flux gap for reciprocation along an axis; and a circular guide depending from a second end of the coil assembly, opposite the first end, and having a smooth, low-friction inner surface, wherein the inner surface of the circular guide has a second inner diameter less than the first inner diameter of the coil assembly but greater than the outer diameter of the pole, and the circular guide has a flexible portion for moving toward the pole as the coil moves in a first direction along the axis and for moving away from the pole as the coil moves in a second direction, opposite the first direction, along the axis; whereby the movement of the flexible portion of the circular guide toward and away from the pole as the coil reciprocates tends to create a current of air flowing down between the pole and the coil assembly, past the flexible portion, up between the coil assembly and the magnet assembly, and out of annular flux gap.

16. The loudspeaker of claim 15 further including a plurality of fins between the magnet assembly and the diaphragm, and in thermal communication with the magnet assembly; whereby the current of air exiting the annular flux gap passes the fins.

17. A broad band acoustic loudspeaker comprising:

a diaphragm having an outer edge;

a coil assembly including a coil wound around a form, the coil assembly having a first end mechanically coupled to the diaphragm;

a pole;

a magnet assembly surrounding the pole for defining therebetween an annular flux gap, the coil assembly being operatively disposed within the annular flux gap for reciprocation along an axis;

a frame; and a suspension for mounting the diaphragm to the frame for reciprocation along the axis, the suspension including a first resilient, suspension member extending between the frame and the outer edge of the diaphragm and a second, resilient suspension member extending between the frame and the outer edge of the diaphragm parallel to, but spatially separated from, the first suspension member.

18. The loudspeaker of claim 17 wherein the first and second suspension members are each formed of a low density, synthetic foam material.

19. The loudspeaker of claim 17 wherein the first and second suspension members each include a roll formed therein, and the rolls are oriented in the same direction.

20. The loudspeaker of claim 17 wherein first suspension member includes an outer flange for mounting to the frame through an outer, resilient pad and an inner flange for mounting to the diaphragm through an inner, resilient pad.

21. The loudspeaker of claim 20 wherein the second suspension member includes an outer flange mounted to an outer resilient pad and an inner flange for mounting to an inner resilient pad for spatially separating the second suspension member from the first suspension member.

22. A broad band acoustic loudspeaker comprising:

a diaphragm;

a coil assembly including a coil wound around a form, the coil assembly having a first end mechanically coupled to the diaphragm;

a pole;

a magnet assembly surrounding the pole for defining therebetween an annular flux gap, the coil assembly being operatively disposed within the annular flux gap for reciprocation along an axis;

a frame; and a suspension for mounting the diaphragm to the frame for reciprocation along the axis, the suspension including an annular, resilient, suspension member extending from the frame to the diaphragm, a ring-shaped, resilient, inner mounting pad for coupling the suspension member to the diaphragm and a ring shaped, resilient outer mounting pad for coupling the suspension member to the frame, thereby allowing the size of the annular gap between the outer edge of a diaphragm and the inner edge of a frame to be narrowed while accommodating a relatively large range of excursion of the diaphragm.

23. The loudspeaker of claim 22 wherein the inner and outer mounting pads each include a foam cushion.

24. The loudspeaker of claim 22 wherein the inner and outer mounting pads each include resilient, first and second parallel mounting flanges each formed of plastic and a resilient interconnecting member formed of plastic.

25. A broad band acoustic loudspeaker comprising:

a diaphragm;

a coil assembly having a first end mechanically coupled to the diaphragm;

a pole; and a magnet assembly surrounding the pole for defining therebetween an annular flux gap, the coil assembly being operatively disposed within the annular flux gap for reciprocation along an axis;

wherein the coil assembly includes a relatively high strength dielectric base layer on which a coil is wound and the coil assembly further includes a layer of ceramic overlaying the coil and a second, dielectric layer encircling and overlaying at least a portion of the ceramic layer.

26. A broad band acoustic loudspeaker comprising:

a diaphragm;

a coil assembly including a coil wound around a coil form, the coil assembly having a first end mechanically coupled to the diaphragm;

a pole;

a magnet assembly surrounding the pole for defining therebetween an annular flux gap, the coil assembly being operatively disposed within the annular flux gap for reciprocation along an axis;

a suspension for coupling an outer edge of the diaphragm to a frame;

a first ring formed from a first, relatively thick layer of a stiff material bonded to a first side of the diaphragm along its outer edge; and a second ring formed from a second, relatively thick layer of stiff material bonded to a second side of the diaphragm opposite the first ring.

27. The loudspeaker of claim 26 wherein the stiff material of the first and the second rings includes a foamed epoxy.

28. A broad band acoustic loudspeaker comprising:

a diaphragm;

a coil assembly including a wire coil wound around a form, the coil assembly having a first end mechanically coupled to the diaphragm;

a pole;

a magnet assembly surrounding the pole for defining therebetween an annular flux gap, the coil assembly being operatively disposed within the annular flux gap for reciprocation along an axis;

a plurality of pairs of ribs formed of a stiff, relatively thick layer of material, each rib in each pair of ribs being disposed opposite each other on opposite sides of the diaphragm and oriented along a radial extending from a center of the diaphragm toward its outer edge.

29. The loudspeaker of claim 28 wherein the stiff material of each of the plurality of pairs of ribs includes a foamed epoxy.

30. The loudspeaker of claim 28 further including an outer stiffening ring disposed one side of the diaphragm along its outer periphery and an inner stiffening ring on the one side of the diaphragm part way between its center and its outer periphery; wherein the plurality of ribs which are on the one side extend between the outer and the inner rings.

* * * * *